United States Patent [19]

Vits

[11] 4,042,233

[45] Aug. 16, 1977

[54] INSTALLATION FOR COLLECTING IDENTICALLY SHAPED, LARGE AND DIFFERENT TYPES OF SHEETS FROM A PLURALITY OF DISPENSING STATIONS AT A COLLATING STATION

[75] Inventor: Hilmar Vits, Leichlingen, Germany

[73] Assignee: VITS-Maschinenbau GmbH, Langenfeld, Germany

[21] Appl. No.: 654,737

[22] Filed: Feb. 3, 1976

Related U.S. Application Data

[63] Continuation-in-part of Ser. No. 466,258, May 2, 1974, abandoned.

[30] Foreign Application Priority Data

May 9, 1973 Germany ..... 2323339

[51] Int. Cl.[2] ..... B65H 39/055

[52] U.S. Cl. ..... 270/58; 156/557

[58] Field of Search ..... 270/58; 271/9; 214/6 M; 156/556, 557, 559

[56] References Cited

U.S. PATENT DOCUMENTS

| | | | |
|---|---|---|---|
| 2,542,089 | 2/1951 | Leifer | 270/58 |
| 3,499,710 | 3/1970 | Sahley | 271/9 X |
| 3,692,298 | 9/1972 | Peacock | 270/58 |
| 3,914,154 | 10/1975 | Pfeiffer | 270/58 |

FOREIGN PATENT DOCUMENTS

| | | | |
|---|---|---|---|
| 1,184,320 | 12/1964 | Germany | 270/58 |
| 1,216,241 | 3/1966 | Germany | 270/58 |

*Primary Examiner*—Edgar S. Burr
*Assistant Examiner*—A. Heinz

[57] ABSTRACT

An installation for the collation of identically-shaped, large, and particularly, different types of sheets from a plurality of dispensing stations at a collecting station. In the installation, sheets stored at a plurality of dispensing stations are conveyed to a collating station without the need for a manual operation, and adapted to be there stacked into a desired laminate. The dispensing stations and the collating station are positioned in series adjacent each other and at a constant spaced relationship, and with a transport or conveying carriage being located above the stations, and supporting controllable gripper elements ahead of the sheet edges and positioned within the spatial regions of the stations for effecting the conveyance thereof, and with the carriage adapted to be oscillated to and fro along the direction of the series of stations at an amplitude in conformance with the spacing between the stations. Preferably, the collating station is centrally located intermediate the dispensing stations.

9 Claims, 12 Drawing Figures

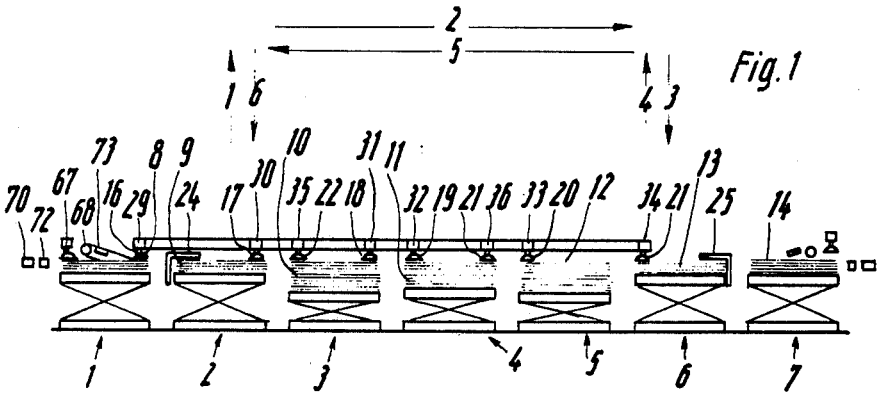
Fig. 1
Fig. 2
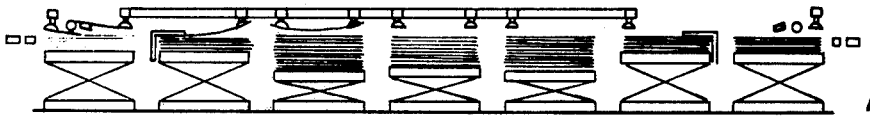
Fig. 3
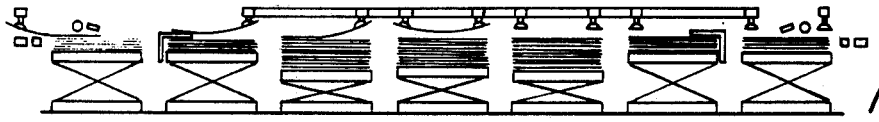
Fig. 4
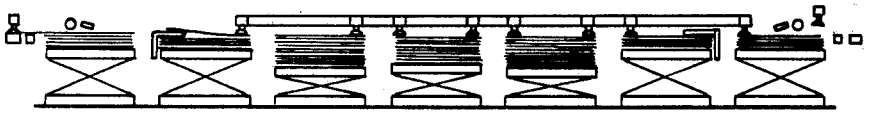
Fig. 5
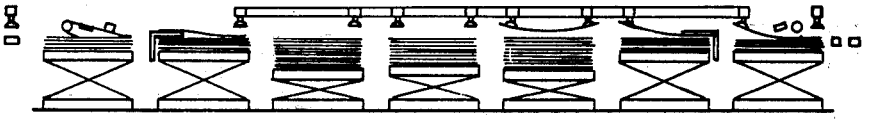
Fig. 6
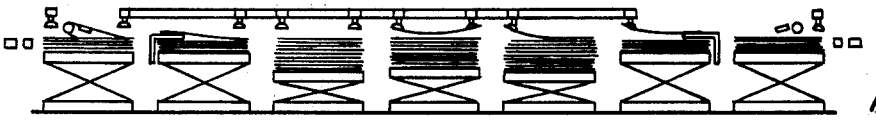
Fig. 7

INSTALLATION FOR COLLECTING IDENTICALLY SHAPED, LARGE AND DIFFERENT TYPES OF SHEETS FROM A PLURALITY OF DISPENSING STATIONS AT A COLLATING STATION

CROSS-RELATED REFERENCES

This is a continuation-in-part of the parent application Ser. No. 466,258 filed May 2, 1974, now abandoned.

FIELD OF THE INVENTION

The present invention relates to an installation for the collation of identically-shaped, large, and particularly, different types of sheets from a plurality of dispensing stations at a collecting station.

In the manufacture of decorative and industrial laminates, identically-shaped, large, and particularly different types of single sheets (usually having measurements in the width lying between 1.30 m and 2.80 m, and in the length between 2.5 m and 7.5 m) are assembled for stacking thereof. Single sheets of the same type are stacked in superimposed relationship at dispensing stations. They are then stacked at a collecting station into the desired laminate which is formed from different types of single sheets.

DISCUSSION OF THE PRIOR ART

The foregoing operation concerning the dispensing of the single sheets, conveyance of the sheets, and stacking of the sheets into the desired laminate is presently manually carried out, generally mostly by female workers. In accordance with the particular intended use of the laminate, various stacking programs are provided, in which there are collated at least two, normally more, and in some instances up to nine sheets having different qualities. Most sheets thereby appear two times, but core or base paper sheets more frequently. A particular difficulty encountered during collation lies in that during the conveyance of a sheet, the sheets located therebelow may be easily displaced on their stacks due to their different coefficients of friction. A further requirement during collation of the sheets may also consist of in that one or more of the sheets, for example, decorative paper, are utilized during the collating sequence.

The collating operation appears, at first glance, to be primitive and of only secondary importance, however, upon close study it has been ascertained that it requires a considerable degree of skill inasmuch as many more individual steps are combined than may seem from mere appearances. In view of the foregoing, during collation, inspection is carried out and irregularities smoothed out in the stacks at the dispensing stations. This operative sequence additionally requires, in particular for a large proportion of the base paper, considerable physical exertion, so that only insufficient labor forces can be found therefore. Since today the tendency is to employ paper sheets which are larger, thinner, and which are provided with more resin so as to be therefore more breakable, manual working therewith even a great degree of skill is no longer adequate, so as to require automation.

SUMMARY OF THE INVENTION

Accordingly, it is an object of the present invention to provide an installation by means of which sheets stored at a plurality of dispensing stations may be conveyed to a collating station without the need for a manual operation, and adapted to be there stacked into the desired laminate.

The foregoing object is inventively solved in that the dispensing stations and the collating station are positioned in series adjacent each other and at a constant spaced relationship, and with a transport carriage being located above the stations, and supporting controllable gripper elements ahead of the sheet edges and positioned within the spatial regions of the stations for effecting the conveyance thereof, and with the carriage adapted to be oscillated to and fro along the direction of the series of stations at an amplitude in conformance with the spacing between the stations. Preferably, the collating station is centrally located intermediate the dispensing stations.

By means of the inventive installation, large sheets may be safely conveyed from the various dispensing stations to the collating station. The conveyance is effected in a stepwise manner, in that the sheets are conveyed from one station to the next dispensing station which is successively closer to the collating station. In that case, the controllable gripper elements always engage the leading or forward sheet edges at the rearmost reversing point of the oscillating motion, and release the sheet at the forwardmost reversing point of the oscillation. When the dispensing stations are located at both sides of the collating station, then for each half-oscillation there is effected a conveyance of the sheet in the direction of the collating station, and namely, one time from one side and another time from the other side thereof. Since the gripper elements are controllable, the collating of the sheets can be carried out pursuant to a predetermined program for forming a particular laminate, considering the type of sheets stored at the various dispensing stations.

As a rule, directly adjacent the collating station there is located the dispensing station for the sheets having a high friction value and of heavy weight, for example, the support or base paper sheets. In order to always ensure that, during conveyance of these sheets to the collating station, the remaining sheets are not displaced, in accordance with an embodiment of the invention, the transport carriage is respectively provided with two rows of gripper elements which are spaced from each other by a sheet length, and which grip the sheets to be conveyed at the forward and rearward edges thereof.

In accordance with a further embodiment of the invention, the more remote and intermediate dispensing stations for sheets having low weights and low coefficients of friction include slide bars which partly extend above the sheets in the dispensing stations from the rear edges. This will eliminate the danger that the sheets which are conveyed above the individual dispensing stations from taking along and displace the respective uppermost sheets at the dispensing station. Any displacement of the uppermost sheet of the dispensing station will afford a detrimental effect insofar as, during conveyance of these sheets the latter no longer are at their predetermined leading edge by the gripper elements, but are gripped thereby in an offset manner, so as to be no longer able to be deposited in correct registration at the collating station.

A constructively advantageous embodiment for the transport carriage consists of a ladder, which has the gripper elements fastened to its rungs.

Preferably, the gripper elements for respectively one sheet edge are constructed as a row of suction apertures extending transversely of the direction of sheet conveyance, and which are to suction or vacuum conduit through controllable valves. Suitable suction apertures are disclosed, for example, in German Patent Application No. P 22 63 732.7.

In order to still further reduce the danger of undesirable displacement of the uppermost sheet in the dispensing stations, each of the slide bar portions may be provided along its lower surface with suction apertures which are directed towards the sheet stack. These suction apertures retain the sheet with a predetermined force, which may however be overcome by the force generated by the gripper elements constructed as suction apertures, so as to permit the conveyance of the sheets.

In order to render easier the conveyance of the sheets above the individual dispensing stations, the dispensing stations may be provided with blow nozzles oriented against the forward or leading sheet edges in the direction of conveyance of the latter. In this embodiment of the invention, the conveyance of the sheets is floatingly effected on an air cushion. Also this measure assists in avoiding the danger of any undesired displacement of the lower sheets.

Suitably, the collating station includes a shaker or vibrator which orients the sheets being deposited into an edgealigned stack. The vibrator may consist of diverging guide blades to which is imparted an oscillating movement. When the edges of the sheet deposited on the collecting stack does not correspond with the edges of the sheets already stacked, the guide blades bring the sheet into the correct position since they function as a feeding hopper.

BRIEF DESCRIPTION OF THE DRAWINGS

Reference may now be had to the following detailed description of the invention illustrating exemplary embodiments, having reference to the accompanying drawings, in which:

FIG. 1 schematically illustrates the motion which the installation must sequentially effect, in which the arrows 1 through 6 designate the direction of motion and the sequence of the movements;

FIGS. 2 through 7 schematically illustrate the installation in which the various figures represent the sequential positions of the installation during collating;

DETAILED DESCRIPTION

Figure 10:
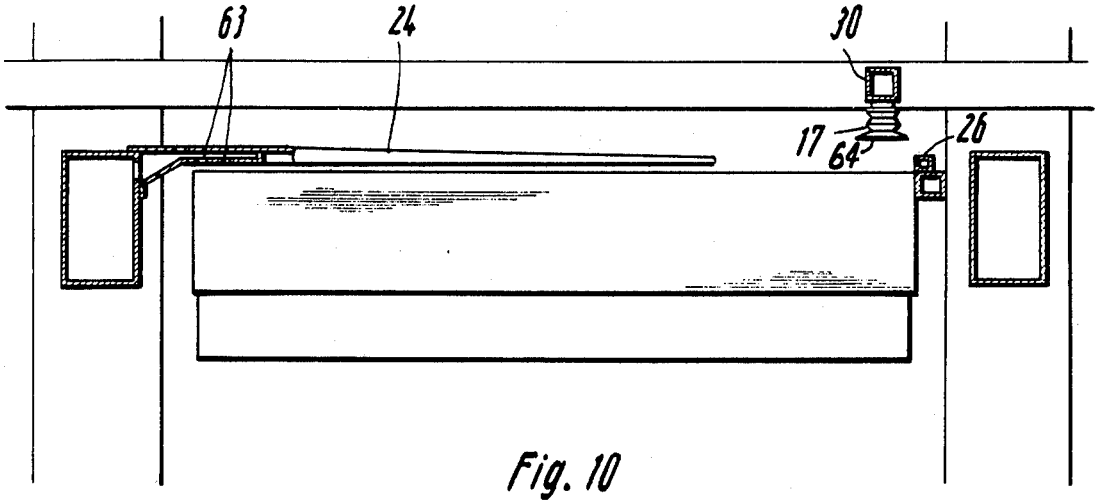
FIG. 10 illustrates, partly in section, a side view of a station of the installation for a sheet which is not to be reversed.
Figure 11:
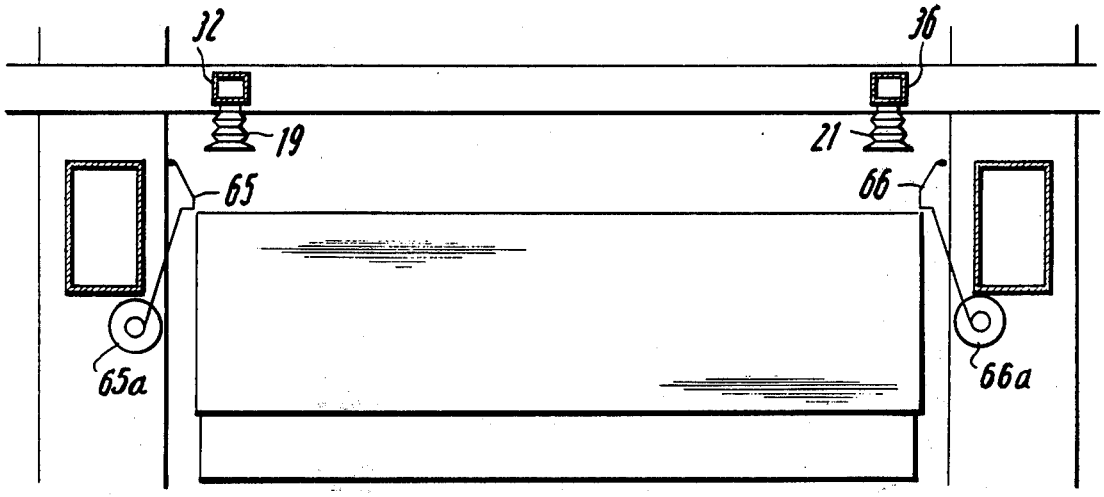
FIG. 11 illustrates, partly in section, a side view of a collating station of the installation.
Figure 12:
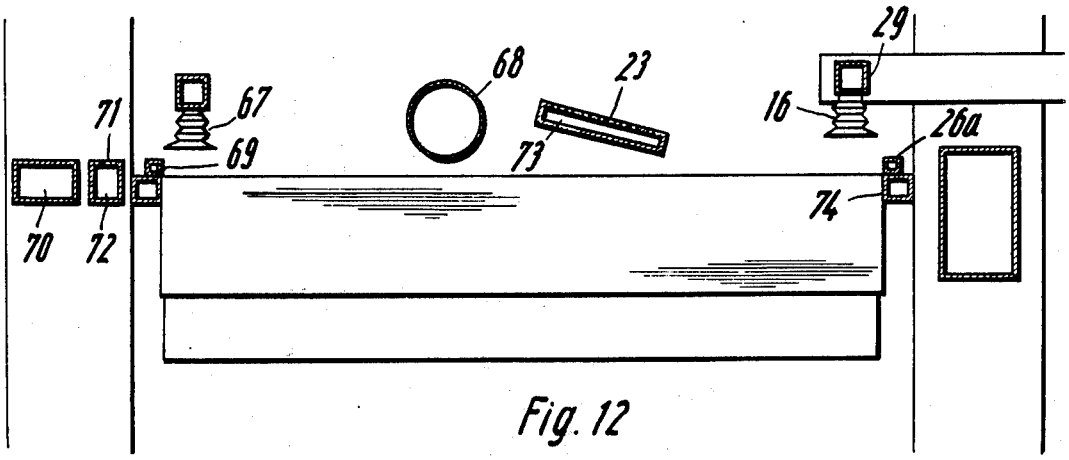
FIG. 12 illustrates, partly in section, a side view of a reversing arrangement for the installation.

Referring now in detail to the drawings, the installation schematically shown in FIGS. 2 through 7, and fragmentarily in FIGS. 10 through 12 in a more detailed representation, includes a plurality of stations 1–7 located adjacent each other in a straight row, each of which respectively support on a pallete a stack of sheets 8–14, and including a conveying carriage 15 above the stations 1–7 and adapted to be swung to and fro, which conveys the sheets from one station to another station. In order to facilitate this conveyance, and to facilitate the edge-aligned collation of the sheets on an intermediate station 4 forming a collating station, stations 1–7 are located at a constant spaced relationship with respect to each other. The conveying carriage 15 includes a plurality of gripper elements 16–21 positioned in the same constant spaced relationship, which correspond to the reversing points of the to-and-fro oscillating movement of the conveying carriage 15 with the leading edges of the stacks 8–14. In the central portion of the conveying carriage 15, in addition to the gripper elements 18 and 19, there are provided additional gripper elements 22, 23, which are spaced from the gripper elements 18 and, respectively 19 by the width of the sheet stack. The gripper elements 16–23 are fastened in groups to the rungs 29–35 of the ladder-shaped conveying carriage 15. In order to always maintain the upper surface of the stack for an undisturbed operation, stations 1–7 may be lifted or lowered by means of suitable cross-linkages.

The collection of the sheets from stations 1–3 and 5–7 to the collating station 4 is effected in accordance with the following schematically illustrated principle:

After the conveying carriage 15 has been lowered (FIG. 2), the gripper elements 16, 17, 18 and 22 are actuated, whereas the gripper elements 19, 20, 21, 23 are not actuated, or are deactivated. The conveying carriage 15 is then raised (FIG. 3), so as to grip and lift the sheets at stations 1 and 2 at their leading edges, and the sheets at station 3 at their leading and rear edges. This motion is, in FIG. 1, designated by arrow 1. The conveying carriage 15 is then moved in the direction of arrow 2 in FIG. 1 towards the right. The path of movement corresponds to the spaced relationship of the stations. The conveyor carriage 15 takes along a sheet during this movement, and transports the latter to a station successively toward the collating station 4 for collecting and stacking the sheets. In order to have the draggedly conveyed lightweight sheet from stations 1 and 2 avoid displacing the sheets located therebelow, it is advantageous that the rear edges of the sheet stacks 9, 13 be contacted by superimposed fingershaped slide bars 24, 25. Such slide bars 24 and 25, which prevent the inadvertent displacement of the sheets, are not required at the stations 3 and 5 which support the heavyweight sheets, since these sheets in view of their inherent weight can hardly be displaced by the thereabove dragged lightweight sheets. In order to prevent the respective upper heavyweight sheets from displacing the therebelow located heavyweight sheets during dragging conveyance thereof, additional gripper elements 22, 23 are provided in the central portions of the conveying installation, and which grip the heavyweight sheets along their leading and rear edges so that the sheets are not draggingly but carryingly conveyed from stations 3 and 5 towards the collating station 4. After the conveying carriage 15 has traversed the path designated by arrow 2, and has reached the position shown in FIG. 4, the conveying carriage 15 is lowered in the direction of arrow 3, and reaches the position illustrated in FIG. 5. In this position, the gripper elements 16, 17, 18 and 22 are deactivated, whereas the gripper elements 19, 20, 21 and 23 are activated. The gripper elements 20, 21 grip the lightweight sheets at stations 6 and 7 at their leading edges, whereas the gripper elements 19, 23 grip the sheets at station 5 at their leading and rear edges. The conveying carriage 15 is then raised in the direction of arrow 4 so as to reach the position illustrated in FIG. 6 and, in conformance with arrow 5, displaced towards the left by the scaled distance. Thereby, the sheets at stations 6 and 7 are draggingly, and the sheets at station 5 are carryingly conveyed along. At the end of the path of movement designated by arrow 5, the conveying carriage 15, which is in the position as shown by arrow 7, is lowered in the direction of arrow 6, so that the conveying carriage 15 again reaches the position shown in FIG. 2. The motion cycle may then be repeated, and is repeated for so long until the desired stack has been collected at the collating station 4. It may be understood that upon any particular movement, a sheet need not be removed from each station 1 to 3, 5, 6 and 7 located either on the right or, respectively, left of collating station 4. In accordance with a preselected program, it is possible that one or more stations may be bypassed during dispensing in order to obtain a desired sequence of the stacked sheets at the collating station 4. This may be achieved by means of actuation of the gripper elements pursuant to a preselected program.

In order to render easier the conveyance of the sheets, and to reduce the danger of undesired displacement of the therebelow located sheets, at the leading edges in the direction of conveyance of the various dispensing stations 1–3, 5–7, there are located blow nozzles 26, **26*a* which are directed toward the leading edges of the sheets, as is shown in FIGS. 10 and 12 with regard to stations 2 and 1**. After lifting of the sheets by means of the gripper elements, the blown air generates an air cushion below the raised sheet, upon which the sheet glides during its conveyance.

Figure 8:
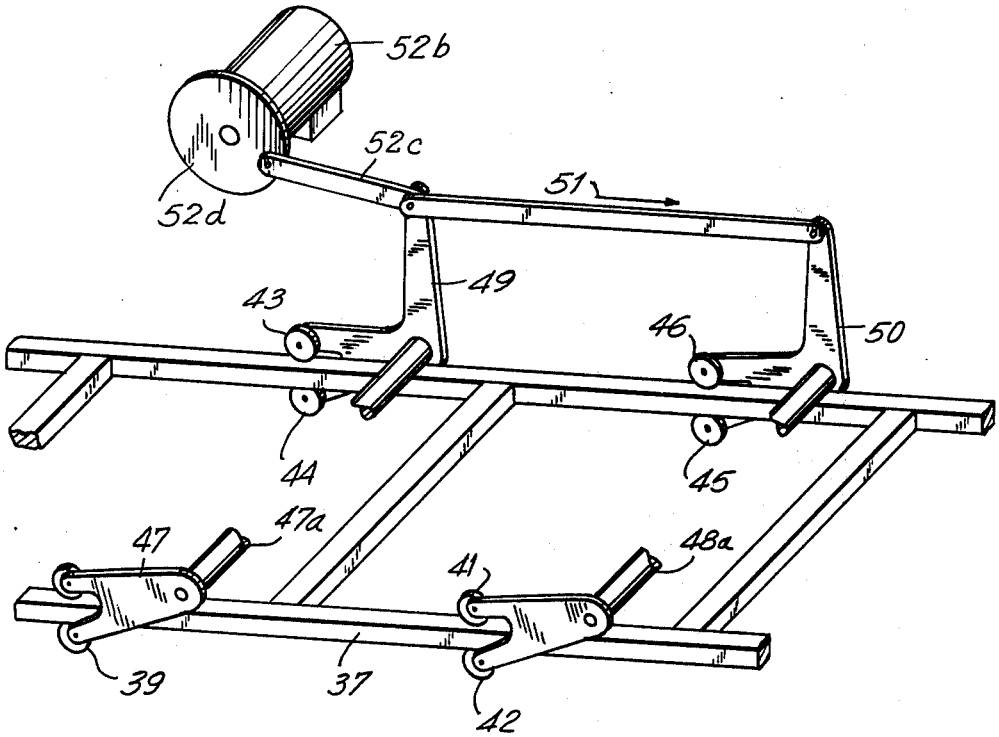
FIG. 8 perspectively illustrates a guide and lifting arrangement for the conveying carriage of the installation.
Figure 9:
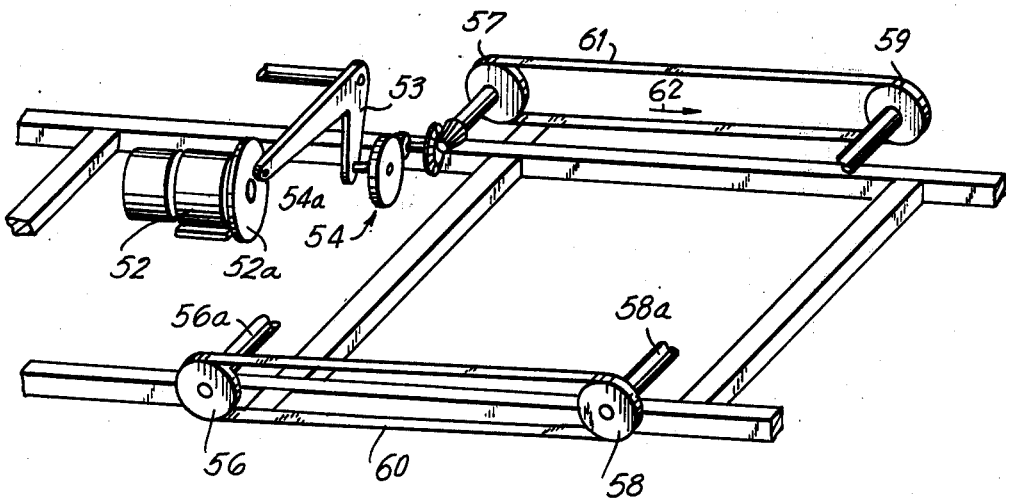
FIG. 9 illustrates, in perspective, a drive for the conveying carriage.

In FIGS. 8 and 9 of the drawing, there are illustrated the guidance, and drive and lifting arrangement for the ladder-shaped conveying carriage 15. In order to facilitate the to-and-fro oscillating movement of the conveying carriage 15, the spars or rails 37, 38 of the ladder are conveyed between rollers 39–46, which are supported on mutually interconnected pivotable levers 47–50. Upon oscillation of levers 47–50 due to a force being exerted in the direction of arrow 51 against levers 49, 50, the carriage 15 may be lifted or lowered, so as to effect the path of movement shown in FIG. 1 and designated by arrows 1, 3, 4 and 6. In order to carry out the oscillating movement, which is illustrated in FIG. 1 through arrows 2 and 5, the conveying carriage 15 is provided with a drive arrangement as shown in FIG. 9. The drive arrangement consists of a motor 52 which drives rigidly interconnected rollers 57 through the intermediary of a schematically illustrated crankshaft 53 and drive 54, which in conjunction with rollers 58 and 59, move two belt drives 60, 61 to-and-fro in a direction along arrow 62. The belt drives 60, 61 are connected with the frame of the carriage 15 so as to impart to the carriage an oscillating to-and-fro movement. The drive arrangement (not shown) for the guide and lifting arrangement shown in FIG. 8 is so coordinated with the drive arrangement shown in FIG. 9 for the to-and-fro oscillating movement of the conveying carriage 15, whereby the lifting and lowering sequence of the conveying carriage 15 only takes place at the reversing point of the oscillating to-and-fro movement of the conveying carriage 15.

The carriage 15 is fastened to belts 60, 61 by the blades illustrated in FIG. 9 which may be regarded as elongations of the left-hand side rung of the ladder. As indicated by arrow 62, the belts 60, 61 do not move in one direction but rather oscillate back and forth. This movement is effected by the gear 54 and the and the crank 53. When the motor 52 rotates in one direction the crank shaft 53 will be turned backwards and forwards because it is eccentrically connected to a disc **52*a* of the motor 52. This backward and forward movement of the crank shaft 53 effects the to and fro movement of the gear 54 and consequently of the belts 60 and 61 because the crank 53 is also eccentrically connected to gear 54 by means of pin 54*a*. The connection to the belts 60, 61 must be made in an area which does not go round the rolls 56–59** but in an area which oscillates in a linear way. Any suitable means for connection, such as bolts or links may be used.

The lifting and lowering device for the carriage 32 is shown in FIG. 8. This device consists of two pairs of levers each having rolls 39–46. Each pair of levers is connected by an axle **47*a*, 48*a*. The axes of these axles are stationary. When a force is imparted to the levers 49 and 50 by means of reciprocating rod 52*c* driven by motor 52*b* and eccentric 52*d*, as indicated by the arrow 51, the levers 49, 50 are turned clockwise from the position shown, whereby the levers are connected to the rolls 39–46 are also tilted in a clockwise direction. Since the rolls 39–46 include between them the carriage 32, the tilting action causes the carriage 32 to be lifted. The moving action as indicated by the arrow 51 may be effected also by a device as shown in FIG. 9 and indicated by the reference number 52. This is a motor with a center disc 52*a*. The center disc is connected with a lever 53 which is moved to and fro. When such a device is connected to the levers 49 and 50 instead of 53, the driving arrangement for the apparatus shown in FIG. 8** is completed.

The finger-shaped slide bars 24 and 25, which extend over the sheets, are illustrated in FIG. 10, in an enlarged scale. The slide bar 24 includes suction apertures 63 in the region of the trailing edge of the sheet, which are designed to additionally secure the uppermost lightweight sheet against inadvertent displacement. The forgoing is effected by means of the sheets being secured and aspirated along its rear edge by suction apertures 63.

The suction force exerted by the suction apertures 63 on the sheets is, however, relatively small so as not to disturb the carrying along of the sheets by means of the gripper elements 17, 20. Due to the relatively low suction force it is consequently not necessary to provide any special control arrangement for these suction apertures 63.

In FIG. 10 there is illustrated, in particular detail, a gripper element 17. The various gripper elements 16–23 are similarly constructed. This gripper element 17 consists of a telescopically constructed, downwardly opening suction cup 64, which is connected to a pressurized tube which is identical to a rung 30 of the ladder-shaped conveying carriage. The suction cup 64 is asymmetrically constructed and, namely, the wall thickness thereof varies with respect to its diametrical size so that the suction cup 64, under pressure, assumes an inclined position with its lower surface, as may be ascertained from FIGS. 3, 4, 6 and 7. The pressurization of suction cups 64 is effected in accordance with a preselected program which, as previously mentioned, is directed pursuant to the requirements of the type of stack which is to be formed. In FIG. 11 the guides 65 and 66 are shown forming a funnel-like entrance so that the sheets, which are not generally deposited edge to edge, are imparted by a force on the edges to bring them into edge alignment.

The collating station illustrated in FIG. 11 includes, in the region of its edges, resiliently constructed guide sheets 65, 66 which are maintained in vibrating motion by reciprocating drive means 65*a,* 66*a,* for example, so as to compensate for unequalities in the edge-aligned stacking of the sheets.

Both of the outermost stations 1 and 7 of the installation are provided with reversing arrangements. In FIG. 12, one such reversing arrangement is illustrated for station 1, together with its essential components. In addition to the gripper elements 16 located on conveying carriage 15, at this station there is provided a further gripper element 67 in the region of the rearward or trailing edge of the sheet stack 8. Along this sheet edge, there is additionally provided a blow nozzle 69 directed against the sheet edge, which has the task, after lifting of the sheet by means of gripper element 67, to blow air between the lifted sheet and the sheet still remaining on the stack, so as to form an air cushion between these two sheets, which renders easier the withdrawal of the uppermost sheet from the stack. Behind the blow nozzle 69 there is located a depositing surface 70; and a tubular beam 72 having an upper suction aperture 71. In the central region above the sheet stack 8 there is provided a conduit 68 which extends transversely to the conveying direction of the installation. Behind the tube 68, in the direction of conveyance, there is located an inclined positioned receptacle 73 having a plurality of suction apertures in its upper surface.

This reversing arrangement operates in the following manner:

In order to reverse the uppermost sheet, the gripper element 67 is at first lowered onto the uppermost sheet so as to engage the sheet and adapt it to be lifted, as is illustrated in FIG. 3. Air is now blown between the raised sheet and the remaining stack 8, so as to facilitate the further conveyance of the upper sheet in accordance with FIG. 4. As soon as the gripper element 67 reaches the position illustrated in FIG. 5, it is deactivated so that the sheet is retained above suction aperture 71. Through this conveyance, the forward region of the therebelow positioned sheet is laid free so that, by means of the gripper element 16, the next sheet may be lifted and conveyed in the direction toward the collating station 4. The uppermost sheet is thereby retained by the suction aperture 71. As soon as the gripper element 16 has been moved out of the region of station 1, by pivoting of the beam 72 into the position illustrated in FIG. 6, the sheet may be reversed so as to contact the stop 74 with its forward most edge, and comes at rest with its forward edge above the edge of the therebelow positioned sheet. The thus reversed sheet may then be engaged and conveyed in a manner similar to a non-rotated sheet by means of the gripper elements. The suction apparatus 71 can only act on a sheet when it has been transported backwards by the suction device 67, so that it lies on the suction device 71. In this position the suction force for device 71 retains the uppermost sheet when the other suction device 16 grips the free leading edge of the next sheet and transports it forwards.

While there has been shown what is considered to be the preferred embodiment of the invention, it will be obvious that modifications may be made which come within the scope of the disclosure of the specification.

I claim:

1. Apparatus for collecting and stacking a plurality of identically shaped sheets comprising: a collating station for collecting and stacking the sheets; at least one pair of sheet dispensing stations positioned on each of two opposite sides of said collating station, each of said sheet dispensing stations being adapted to store sheets identical in size and weight, said dispensing stations and said collating station being located in a row uniformly spaced relative to each other; movable sheet-conveying carriage positioned above said dispensing and collating stations, and driving means for incrementally reciprocating said carriage to and fro above said row of stations at an incremental amplitude corresponding to the spatial distances between said stations for transporting said sheets in a direction toward said collating station; individually controllable gripper elements mounted on said carriage at predetermined locations and having means for simultaneously gripping one sheet from at least one of each of said pair of opposed dispensing stations at an edge of the sheet leading in the direction of motion toward the collating station; means lowering said gripper elements for gripping the sheets, whereby the sheets thus gripped are conveyed sequentially from the dispensing stations towards said collating station for stacking thereon, each of said gripper elements being controlled individually for building up stacks of different order, the sheets being collated by transporting the sheets from one dispensing station to the other, the sheets being transported step-by-step in the direction toward said collating station; a pair of rows of said gripper elements mounted on said carriage and spaced by about a sheet length relative to each other and adapted to respectively engage the gripped sheet along the leading and trailing edges thereof.

2. Apparatus for collecting and stacking a plurality of identically shaped sheets comprising: a collating station for collecting and stacking the sheets; at least one pair of sheet dispensing stations positioned on each of two opposite sides of said collating station, each of said sheet dispensing stations being adapted to store sheets identical in size and weight, said dispensing stations and said collating station being located in a row uniformly spaced relative to each other; movable sheet-conveying carriage positioned above said dispensing and collating stations and driving means for incrementally reciprocating said carriage to and fro above said row of stations at an incremental amplitude corresponding to the spatial distances between said stations for transporting said sheets in a direction toward said collating station; individually controllable gripper elements mounted on said carriage at predetermined locations and having means for simultaneously gripping one sheet from at least one of each of said pair of opposed dispensing stations at an edge of the sheet leading in the direction of motion toward the collating station; means lowering said gripper elements for gripping the sheets, whereby the sheets thus gripped are conveyed sequentially from the dispensing stations towards said collating station for stacking thereon, each of said gripper elements being controlled individually for building up stacks of different order, the sheets being collated by transporting the sheets from one dispensing station to the other, the sheets being transported step-by-step in the direction toward said collating station.

3. Apparatus as claimed in claim 1, at least an outermost of said dispensing stations of each said pair being adapted to dispense sheets having low coefficients of friction and low weight, slide bar means being superimposed on at least the trailing edges of said sheets stacked at said stations for maintaining alignment of the sheets.

4. Apparatus as claimed in claim 3, each said slide bar means having suction apertures on a lower face thereof directed toward the sheet stack at said stations.

5. Apparatus as claimed in claim 1, said carriage being substantially ladder-shaped and having wings, said gripper elements being fastened to the rungs of said ladder-shaped carriage.

6. Apparatus as claimed in claim 1, said gripper elements comprising suction cups positioned in rows extending transverse to the direction of conveyance of said sheets, and controllable valve means selectively connecting said suction cups to a source of reduced pressure.

7. Apparatus as claimed in claim 1, at least some of said dispensing stations comprising blow nozzles directed toward the leading edges of said sheets opposite to the direction of conveyance thereof.

8. Apparatus as claimed in claim 1, said collating station comprising vibrating means for orienting the sheets being stacked into an edge-aligned stack.

9. Apparatus for collecting and stacking a plurality of identically shaped sheets comprising: a collating station for collecting and stacking the sheets; at least one pair of sheet dispensing stations positioned on each of two opposite sides of said collating station, each of said sheet dispensing stations being adapted to store sheets identical in size and weight, said dispensing stations and said collating station being located in a row uniformly spaced relative to each other, movable sheet-conveying carriage positioned above said dispensing and collating stations and driving means for incrementally reciprocating said carriage to and fro above said row of stations at an incremental amplitude corresponding to the spatial distances between said stations for transporting said sheets in a direction toward said collating station; individually controllable gripper elements mounted on said carriage at predetermined locations and having means for simultaneously gripping one sheet from at least one of each of said pair of opposed dispensing stations at an edge of the sheet leading in the direction of motion toward the collating station means lowering said gripper elements for gripping the sheets, whereby the sheets thus gripped are conveyed sequentially from the dispensing stations towards said collating station for stacking thereon, each of said gripper elements being controlled individually for building up stacks of different order related to the characteristics of the sheets, said collating station being positioned intermediate, and centrally of said plurality of sheet dispensing stations, said carriage comprising a pair of rows of gripper elements, said rows being spaced from each other by about a sheet length relative each other and adapted to respectively engage the sheet being conveyed along the leading and trailing edges thereof, at least an outermost of said dispensing stations of each said pair being adapted to dispense sheets having low coefficients of friction and low weight, slide bar means being superimposed on at least the trailing edges of said sheets stacked at said stations for maintaining alignment of the sheets, said carriage being substantially ladder-shaped and having rungs, said gripper elements being fastened to the rungs of said ladder-shaped carriage, said gripper elements comprising suction cups positioned in rows extending transverse to the direction of conveyance of said sheets; and controllable valve means selectively connecting said suction cups to a source of reduced pressure; each said slide bar means having suction apertures on a lower face thereof directed toward the sheet stack at said stations, at least some of said dispensing stations comprising blow nozzles directed toward the leading edges of said sheets opposite to the direction of conveyance thereof, said collating station comprising vibrating means for orienting the sheets being stacked into an edge-aligned stack.

* * * * *